US006177852B1

(12) United States Patent
Tada et al.

(10) Patent No.: US 6,177,852 B1
(45) Date of Patent: Jan. 23, 2001

(54) DIELECTRIC FILTER, DIELECTRIC DUPLEXER, AND TRANSCEIVER

(75) Inventors: Hitoshi Tada; Hideyuki Kato, both of Ishikawa-ken (JP)

(73) Assignee: Murata Manufacturing Co., Ltd. (JP)

( * ) Notice: Under 35 U.S.C. 154(b), the term of this patent shall be extended for 0 days.

(21) Appl. No.: 09/314,992

(22) Filed: May 20, 1999

(30) Foreign Application Priority Data

May 21, 1998 (JP) ..... 10-139575
Apr. 15, 1999 (JP) ..... 11-108331

(51) Int. Cl.[7] ..... H01P 1/20; H01P 5/12

(52) U.S. Cl. ..... 333/202; 333/206; 333/207; 333/134

(58) Field of Search ..... 333/202, 206, 333/207, 134

(56) References Cited

U.S. PATENT DOCUMENTS

| | | | | |
|---|---|---|---|---|
| 4,823,098 | | 4/1989 | De Muro et al. | 333/206 |
| 4,896,124 | * | 1/1990 | Schwent | 333/206 |
| 5,065,120 | * | 11/1991 | Munn | 333/207 |
| 5,602,518 | * | 2/1997 | Clifford, Jr. et al. | 333/202 |
| 5,793,267 | * | 8/1998 | Tada et al. | 333/202 |
| 6,087,911 | * | 7/2000 | Tada et al. | 333/206 |

FOREIGN PATENT DOCUMENTS

| | | |
|---|---|---|
| 195 26 583 | 2/1996 | (DE) . |
| 0899806 | 3/1999 | (EP) . |
| 837405 | 2/1996 | (JP) . |

* cited by examiner

*Primary Examiner*—Robert Pascal
*Assistant Examiner*—Patricia T. Nguyen
(74) *Attorney, Agent, or Firm*—Ostrolenk, Faber, Gerb & Soffen, LLP

(57) ABSTRACT

The present invention provides a dielectric filter and a dielectric duplexer, each including a plurality of dielectric resonators. The dielectric filter and the dielectric duplexer each comprising: a dielectric block having a first surface and a second end surface opposite to each other; at least three resonator holes passing through the first end surface to the second end surface of the dielectric block; inner conductors disposed on the inner wall surfaces of the resonator holes; an outer conductor disposed on the external surface of the dielectric block; the outer conductor on the first end surface of the dielectric block being separated into an inner part and a peripheral part by a nonconductive portion; the inner part including the openings of at least three of the resonator holes adjacent to each other; a peripheral part being arranged around the inner part; and the inner part and the peripheral part being connected by a microinductance-generating means.

16 Claims, 7 Drawing Sheets

DIELECTRIC FILTER, DIELECTRIC DUPLEXER, AND TRANSCEIVER

BACKGROUND OF THE INVENTION

1. Field of the Invention

The present invention relates to a dielectric filter, a dielectric duplexer, and a transceiver.

2. Description of the Related Art

Recently, a small, light in weight, and thin-type of radio communication equipment such as a mobile phone have been rapidly popular. In addition to this tendency, electronic components which are to be mounted on such a type of radio communication equipment are required to have a small size and a reduced height. Furthermore, a dielectric duplexer, which is an antenna-shared unit for performing reception and transmission by a single antenna, is required to be small-sized, lightweight, and lower in height.

Conventionally, a dielectric duplexer used as an antenna-shared unit in a mobile phone or the like adopts a structure in which resonator holes of a plurality of dielectric resonators are aligned in a straight line in a single dielectric block. However, generally, both a filter on the transmitting side and a filter on the receiving side, which are composed of dielectric resonators formed on the dielectric block, are allowed to block a pass band of the counter-side filter by band-pass filter characteristics, so that it is difficult to obtain sufficient attenuation in an attenuation band, as long as the number of the dielectric resonators is not increased. Thus, the dielectric duplexer having a structure in which the resonator holes are aligned in a straight line, needs to be large overall.

As a result, it is considerable, for example, that the transmitting filter may be formed by a band-block filter. When a single dielectric block is used, a transmission-line conductor is disposed for coupling adjacent resonators by setting a phase difference of $\pi/2$ (rad) between them. In this case, since the transmission line is a microstrip line whose half-face is dielectric and its other half-face is air, the electrical length of the line is longer than the resonator length of the dielectric resonator, so that the dimension of the aligning direction of the resonators is very large.

In addition, for example, even though the transmitting filter is used as a band-block filter in the case of an antenna-shared unit, when the transmitting filter side is viewed from the side of the receiving filter, in the pass band of the receiving filter, namely, in the block band of the transmitting filter, impedance is substantially zero, so that receiving signals from the antenna flow to the side of the transmitting filter. In order to avoid such a situation, it is necessary to dispose a phase unit having the electrical length of $\pi/2$ between the transmitting filter and an antenna terminal so as to make the impedance in the block band of the transmitting filter viewed from the side of the receiving filter infinite. However, this arrangement increases the number of components in the radio communication equipment, thereby leading to rising in cost.

In order to solve the above-mentioned problems in the conventional dielectric duplexer, for example, a duplexer shown in FIGS. 9A to 9C is presented. The duplexer comprises rectangular-parallelepiped formed dielectric block 1, and with respect to it, various holes, and an electrode film are formed. In other words, 2*a*, 2*b*, 2*c*, 5*a*, 5*b*, and 5*c* are resonator holes on the side of the transmitting filter of the dielectric duplexer; and 4*a*, 4*b*, 4*c*, and 4*d* are resonator holes on the side of the receiving filter. Numeral reference 3 is an input-output coupling resonator hole.

Each of the respective resonator holes 2*a* through 5*c* is a step hole whose internal diameters of the upper half part and the lower half part in FIG. 9B mutually differ. In order not to make the figure complicated, resonator holes 5*b* and 5*c* are not shown in FIG. 9B. In this figure, 12*a*, 12*b*, and 12*c* are inner conductors formed on the inner wall surfaces of the resonator holes 2*a*, 2*b*, and 2*c*; 15*a* is an inner conductor formed on the inner wall surface of the resonator hole 5*a*; 14*a*, 14*b*, 14*c*, and 14*d* are inner conductors formed on the inner wall surfaces of the resonator holes 4*a*, 4*b*, 4*c*, and 4*d*; and 13 is an inner conductor formed on the inner wall surface of the input-output coupling resonator hole 3.

In addition, in each of the inner conductors except for the inner conductors 12*a* and 13, a nonconductive portion indicated by g is disposed near the extremity of a step hole having a longer internal diameter so as to use this part as a disconnection end. Holes 6*a*, 6*b*, and 6*c* shown in FIG. 9A are ground holes, in which inner conductors are formed on the entire inner peripheral surfaces of the straight holes with fixed internal diameters. On the external surface of the dielectric block 1 are formed a transmitting terminal Tx and an antenna terminal ANT, respectively connecting to the inner conductors 12*a* and 13 of the resonator holes 2*a* and 3; and a receiving terminal Rx is formed to make capacitance between it and the inner conductor 14*d* of the resonator hole 4*d*. Furthermore, an outer conductor 10 is formed on the substantially entire surface except for these terminals Tx, Rx, and ANT.

Meanwhile, in the dielectric duplexer having the aforementioned structure, as shown in FIGS. 9A to 9C, since the resonator holes 2*a* through 2*c*, 3, 5*a* through 5*c* and the ground holes 6*a* through 6*c* of the dielectric resonators comprising a filter on the transmitting side are aligned in a staggering form in the dielectric block 1, the dimension w of the aligning direction of the resonator holes 2*a* through 2*c* is reduced, whereas the height h is increased when it is mounted on a print circuit board, or the like. In addition, in the conventional dielectric duplexer, arrangement of the resonator holes 2*a* through 2*c* and the ground holes 6*a* through 6*c* are complicated, and also it is difficult to form and manufacture the dielectric block 1.

Furthermore, in the dielectric duplexer shown in FIG. 9, only $Q_0$ characteristics of approximately $2/3$ is obtainable as compared with the one having the same height as that in which the resonator holes are aligned in a line in the dielectric block; and when the height h is reduced, the characteristics are deteriorated.

SUMMARY OF THE INVENTION

To overcome the above described problems, the present invention provides a dielectric filter, a dielectric duplexer, and a transceiver, which have a lower height and good characteristics, and can be easily manufactured.

One preferred embodiment of the present invention provides a dielectric filter or a dielectric duplexer including a plurality of dielectric resonators, the dielectric filter comprising: a dielectric block having a first surface and a second end surface opposite to each other; at least three resonator holes passing through the first end surface to the second end surface of the dielectric block; inner conductors disposed on the inner wall surfaces of the resonator holes; an outer conductor disposed on the external surface of the dielectric block; the outer conductor on the first end surface of the dielectric block being separated into an inner part and a peripheral part by a nonconductive portion; the inner part including the openings of at least three of the resonator holes adjacent to each other; a peripheral part being arranged around the inner part; and the inner part and the peripheral part being connected by a microinductance-generating means.

The microinductance-generating unit is, for example, a conductor pattern integrated with the outer conductor, or a metallic lead wire.

In the dielectric filter and the dielectric duplexer having such a structure, among the respective dielectric resonators formed by at least three resonator holes surrounded by the nonconductive portion, the dielectric resonator using the first end surface side as a short-circuit end is grounded through the microinductance generating unit. This arrangement permits mutual comb-line coupling between the dielectric resonators using the first end surface side as a short-circuit end among the three dielectric resonators. As a result, it is not necessary to dispose mutually coupling dielectric resonators in a staggering form in the dielectric block.

In the above described dielectric duplexer or dielectric duplexer, the openings of the resonator holes included in the inner part may be disposed in a recess provided on the first end surface of the dielectric block, and the nonconductive portion may be disposed on the inner wall surface of the recess.

Since the recess allows the nonconductive portion and the openings of the resonator holes to be recessed from a first end surface of the dielectric block, influence of the leaking electromagnetic field on the other electronic components mounted on a circuit board can be suppressed. Similarly, influence of the electromagnetic field leaking from the other electronic components on the dielectric filter and the dielectric duplexer can be also suppressed.

In the above described dielectric filter or dielectric duplexer, a coupling-block ground hole may be disposed between the resonator holes which the openings thereof are included in the inner part. Such a coupling-block ground hole between the resonator holes surrounded by the nonconductive portion permits the coupling-block ground hole to cut off mutual electromagnetic coupling between the resonator holes disposed on both sides of the coupling-block ground hole by the blocking action.

Further, a transceiver employed in the present invention includes at least either one of the dielectric filter or the dielectirc duplexer having the aforementioned characteristics, so that the device can be flexible in reducing the height thereof.

Other features and advantages of the present invention will become apparent from the following description of preferred embodiments of the invention which refers to the accompanying drawings, wherein like reference numerals indicate like elements to avoid duplicative description.

BRIEF DESCRIPTION OF DRAWINGS

FIGS. 1A, 1B to 1C show a structure of a first preferred embodiment of a dielectric duplexer according to the present invention, in which FIG. 1A is a back view; FIG. 1B is a plan view; and FIG. 1C is a front view.

FIGS. 9A, 9B and 9C show a structure of a conventional dielectric duplexer, in which FIG. 9A is a back view; FIG. 9B is a plan view; and FIG. 9C is a front view.

DESCRIPTION OF THE PREFERRED EMBODIMENTS

[First Preferred Embodiment, FIGS. 1A through 4]

Figure 1A:
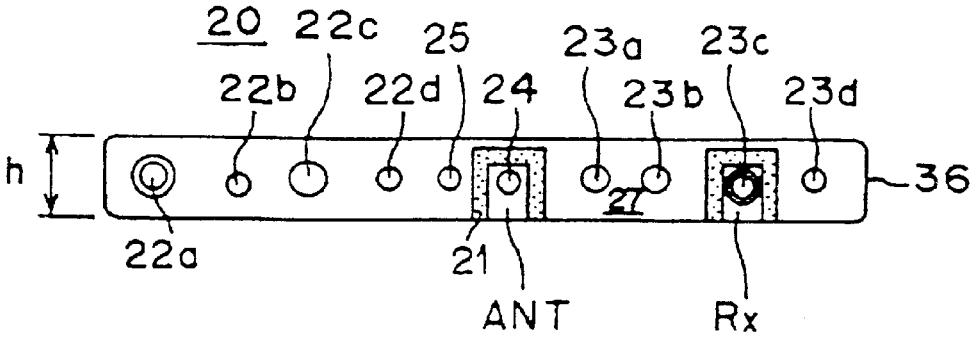
Figure 1B:
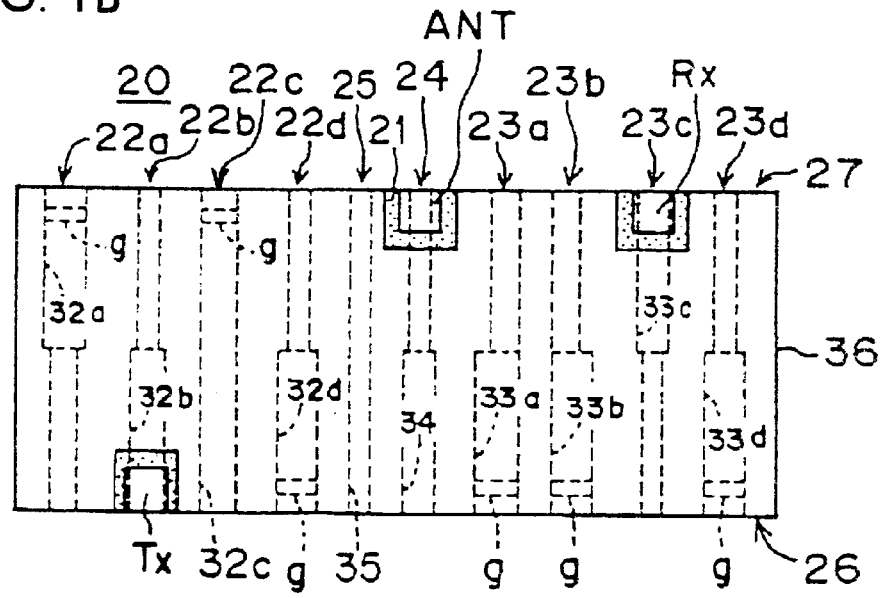
Figure 1C:
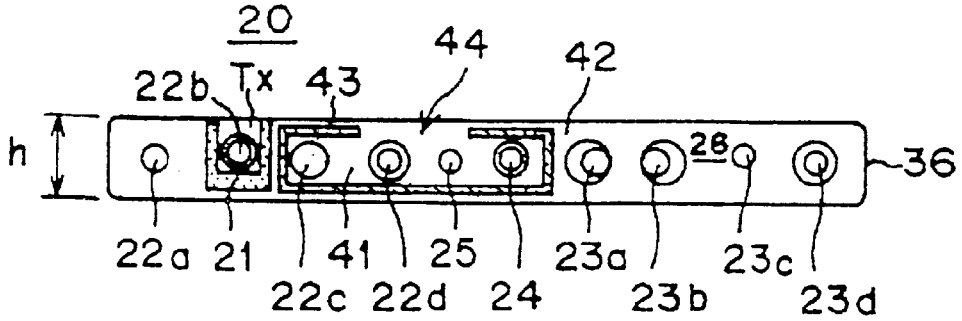

A first preferred embodiment of the dielectric duplexer according to the present invention is shown in FIGS. 1A, 1B and 1C. In the dielectric duplexer 20, the transmitting side comprises two band-block filters, and the receiving side comprises two band-pass filters and a trap. In a dielectric block 21 of a rectangular parallelepiped form are formed resonator holes 22*a* through 22*d* of the transmitting filter side, resonator holes 23*a* through 23*d* of the receiving filter side, an input-output coupling resonator hole 24, and a ground hole 25. The resonator holes 22*a* through 22*d*, 23*a* through 23*d*, 24, and the ground hole 25 are aligned in a straight line in the dielectric block 21; and this arrangement is different from the dielectric duplexer shown in FIG. 9.

Each of the resonator holes 22*a* through 22*d*, 23*a* through 23*d*, 24, and the ground hole 25, as shown in FIG. 1B, are step holes which pass through a first surface 26 of the dielectric block 21 to an opposing second surface 27, and the respective step holes have internal diameters of different lengths in the upper half part and the lower half part thereof. Inner conductors 32*a* through 32*d* are formed on the inner wall surfaces of the resonator holes 22*a* through 22*d*; and inner conductors 33*a* through 33*d* are formed on the inner wall surfaces of the resonator holes 23*a* through 23*d*. An inner conductor 34 is formed on the inner wall surface of the input-output coupling resonator hole 24. The ground hole 25 is a straight hole having an internal diameter of a fixed length; and an inner conductor 35 is formed on the entire inner peripheral surface thereof.

In each of the inner conductors except for the inner conductors 32*b*, 33*c*, and 34, a nonconductive portion indicated by g is formed near the extremity of a step hole with a longer internal diameter, and this part (which is, in other words, the part electrically separated from an outer conductor 36) is a disconnection end. Meanwhile, the part of the inner conductor opposing the disconnection part, (which is, in other words, the part electrically connected to the outer conductor 36), is a short-circuit end. On the external surface of the dielectric block 21 are formed a transmitting terminal Tx connected to the inner conductor 32*b* of the resonator hole 22*b*, a receiving terminal Rx connected to the inner conductor 33*c* of the resonator hole 23*c*, and an antenna terminal ANT connected to the inner conductor 34 of the resonator hole 24; and furthermore, the outer conductor 36 is formed on the substantially entire surface except for the transmitting terminal Tx, the receiving terminal Rx, and the antenna terminal ANT.

As shown in FIG. 1C, in the inner part 41 on a first end surface 26 of the dielectric block 21, the outer conductor 36 is cut away in a letter-C form to dispose a nonconductve portion 43 in such a manner that the resonator holes 22*c* and 22*d*, the input-output coupling resonator hole 24, and the ground hole 25 are surrounded. A conductor pattern 44 left near the center of the nonconductive portion 43 is integrated with the outer conductor 36; and it is a microinductance generating means for mutually connecting the inner part 41 and the outer part 42 which are electrically separated by the nonconductive portion 43.

In the dielectric duplexer 20 having the aforementioned structure, the disconnection ends and the short-circuit ends of the inner conductor 33*a* formed in the resonator hole 23*a* and the inner conductor 33*b* formed in the resonator hole 23*b* are disposed in the mutually same direction so as to produce a comb-line coupling between the inner conductors 33*a* and 33*b*, whereas the disconnection ends and the short-circuit ends of the inner conductor 33*a* formed in the resonator hole 23*a* and the inner conductor 34 formed in the input-output coupling resonator hole 24 are disposed in the mutually reversed direction so as to produce an inter-digital coupling between the inner conductors 33*a* and 33*b*, and similarly, so as to produce an inter-digital coupling between the inner conductor 33*b* formed in the resonator hole 23*b* and the inner conductor 33*c* formed in the resonator hole 23*c*. This permits formation of two band-pass filters between the antenna terminal ANT and the receiving terminal Rx. In addition, an inter-digital coupling occurs between the inner conductor 33*c* formed in the resonator hole 23*c* and the inner conductor 33*d* formed in the resonator hole 23*d*. This permits formation of a trap on the receiving side.

Meanwhile, a comb-line coupling occurs between the inner conductor 32*c* formed in the resonator hole 22*c* and the inner conductor 34 formed in the input-output coupling resonator hole 24 by the nonconductive portion 43, whereas an inter-digital coupling occurs between the inner conductor 32*b* formed in the resonator hole 22*b* and the inner conductor 32*c* formed in the resonator hole 22*c*. This permits formation of a wide-band band-block filter between the transmitting terminal Tx and the antenna terminal ANT. Furthermore, an inter-digital coupling occurs between the inner conductors 32*a* formed in the resonator hole 22*a* and 32*b* formed in the resonator hole 22*b*, and between the inner conductor 32*c* formed in the resonator hole 22*c* and the inner conductor 32*d* formed in the resonator hole 22*d*. This permits formation of two traps on the transmitting side.

Figure 2:
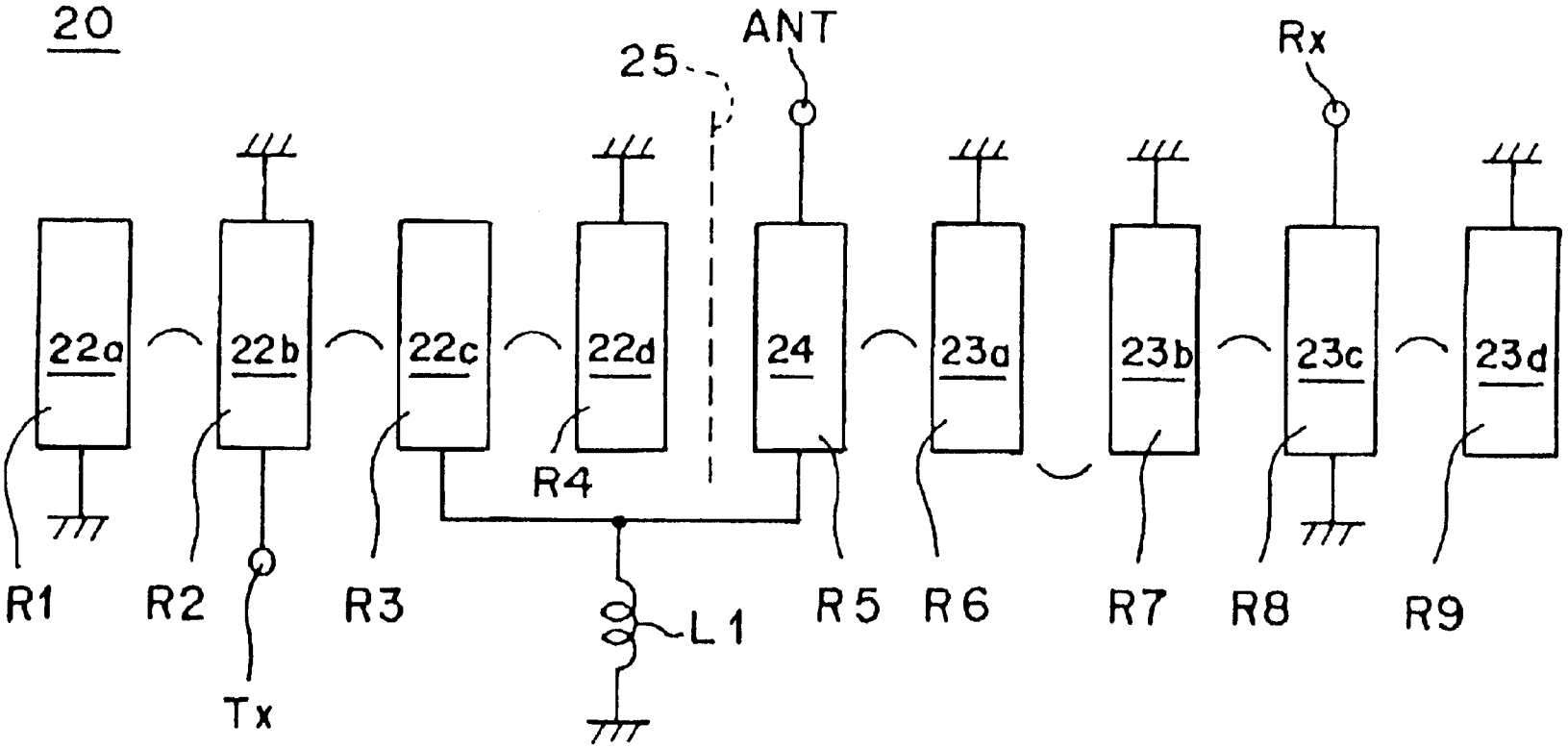
FIG. 2 is an electric equivalent circuit diagram of the dielectric duplexer shown in FIG. 1.

FIG. 2 shows an electric equivalent circuit diagram of the dielectric duplexer 20. In the dielectric block 21 are disposed dielectric resonators R1 through R4 formed by the respective resonator holes 22*a* through 22*d* on the transmitting filter side, a dielectric resonator R5 formed by the input-output coupling resonator hole 24, and respective dielectric resonators R6 through R9 formed by the resonator holes 23*a* through 23*d* on the receiving filter side. Between the dielectric resonators R1 and R3 is disposed the dielectric resonator R2 which is connected to the transmitting terminal Tx; between the dielectric resonators R4 and R6 is disposed the dielectric resonator R5 which is connected to the antenna terminal ANT; and furthermore, between the dielectric resonators R7 and R9 is disposed the dielectric resonator R8 which is connected to the receiving terminal Rx. The dielectric resonator R4 and the dielectric resonator R5 connected to the antenna terminal ANT are electromagnetically mutually shielded by the inner conductor 35 of the ground hole 25.

In the transmitting side, a wide-band band-block filter is formed by the dielectric resonators R2, R3, and R5, and the trap formed by the dielectric resonators R2 and R4 is combined with this to comprise two band-block filters. The dielectric resonators R3 and R5 are grounded through a microinductance L1 (see FIG. 2) formed of a conductor pattern 44 which is located near the center of the nonconductive portion 43 shown in FIG. 1C. Namely, regarding the dielectric resonators R3 and R5, the part on the side of a first end surface 26 is a short-circuit end. This allows a comb-line coupling between the dielectric resonators R3 and R5. Furthermore, modifications in the form and pattern of the conductor pattern 44 permit changing of values of the microinductance, so that electromagnetic coupling between the dielectric resonators R3 and R5 can be easily adjusted.

Figure 9A:
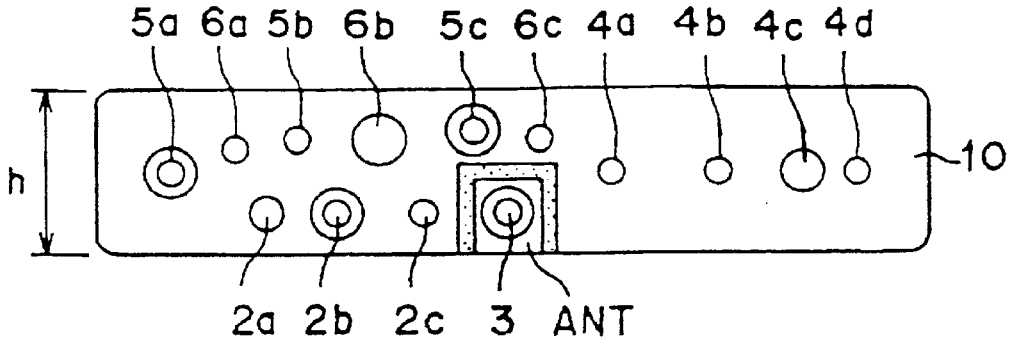
FIG. 9A PRIOR ART
Figure 9B:
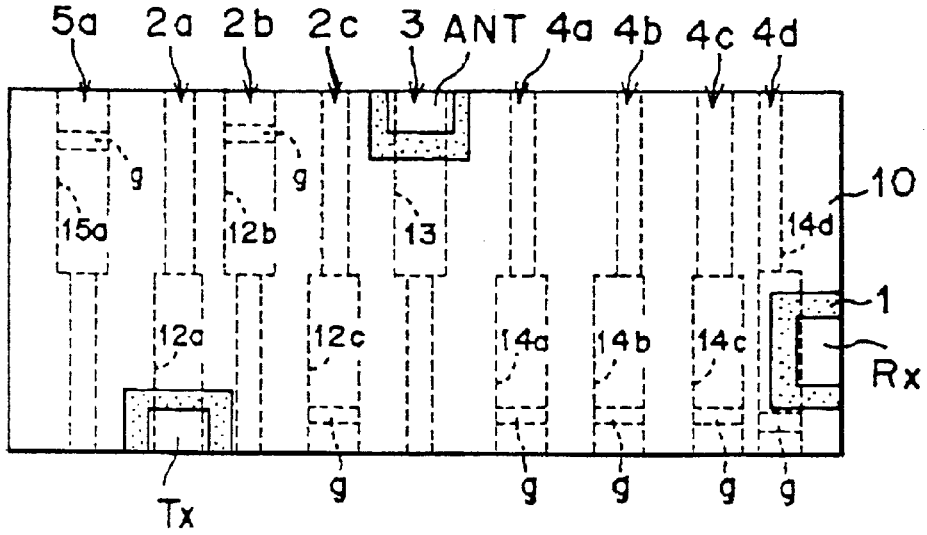
FIG. 9B PRIOR ART
Figure 9C:
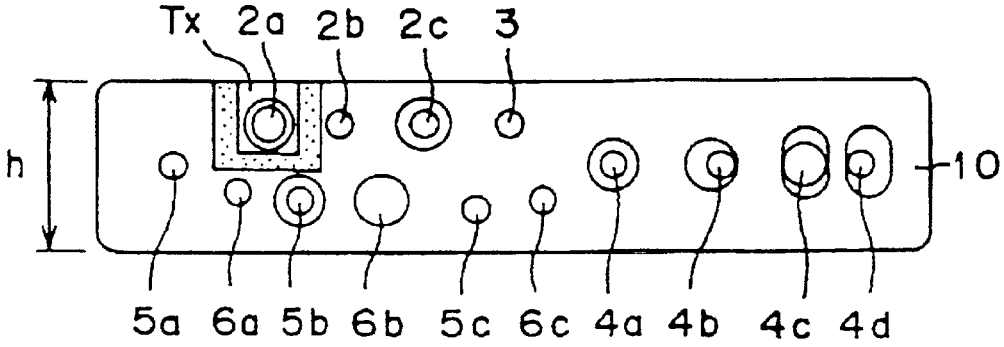
FIG. 9C PRIOR ART

In this arrangement, the dielectric duplexer 20 is different from the conventional dielectric duplexer shown in FIG. 9, since it is not necessary to dispose the resonator holes 22*a* through 22*d*, 23*a* through 23*d*, and 24 in the dielectric block 21 in a staggering form. This allows the mounting height h of the dielectric duplexer 20 to be significantly lower than that of the conventional dielectric duplexer, so that the dielectric block 21 can be easily manufactured.

Figure 3:
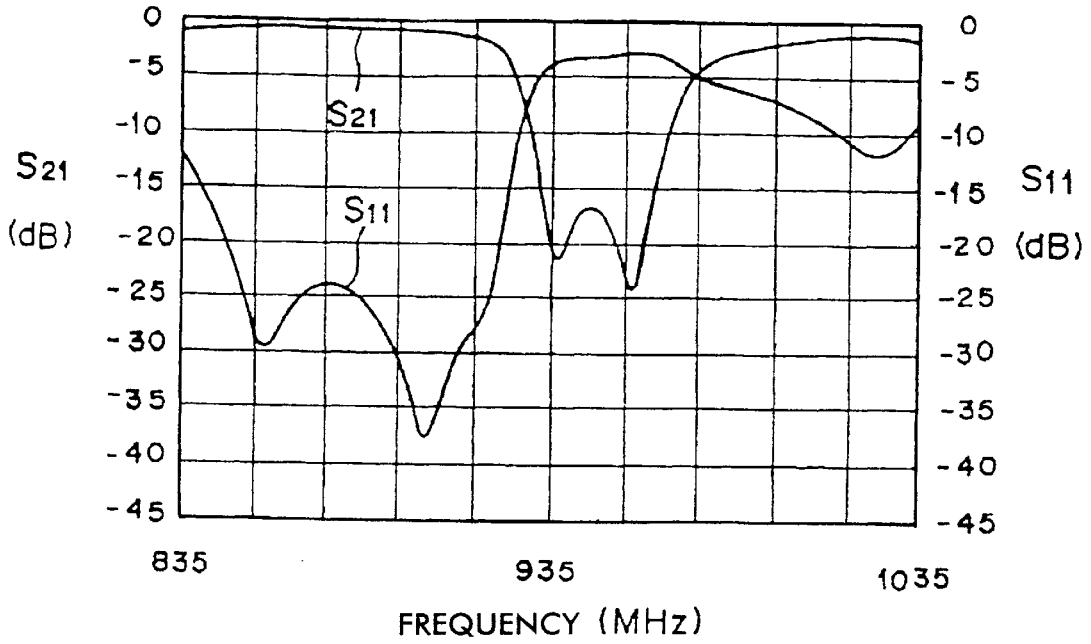
FIG. 3 is a transmitting-side filter characteristic view of the dielectric duplexer shown in FIG. 1.
Figure 4:
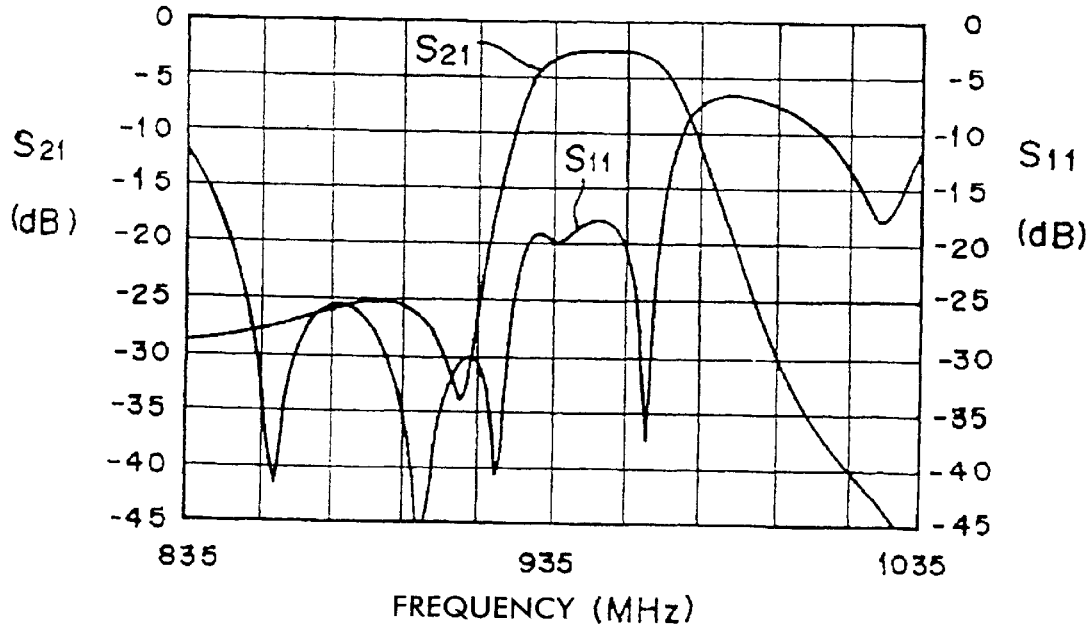
FIG. 4 is a receiving-side filter characteristic view of the dielectric duplexer shown in FIG. 1.

Under the condition in which the mounting height h is equal, characteristics of the dielectric duplexer 20 are improved more than those of the dielectric duplexer shown in FIG. 9. The measured values of pass characteristics S21 and reflection characteristics S1 of the transmitting filter in the dielectric duplexer 20 are shown in FIG. 3; and the measured values of pass characteristics S21 and reflection characteristics S11 of the receiving filter in the dielectric duplexer 20 are shown in FIG. 4.

Figure 5:
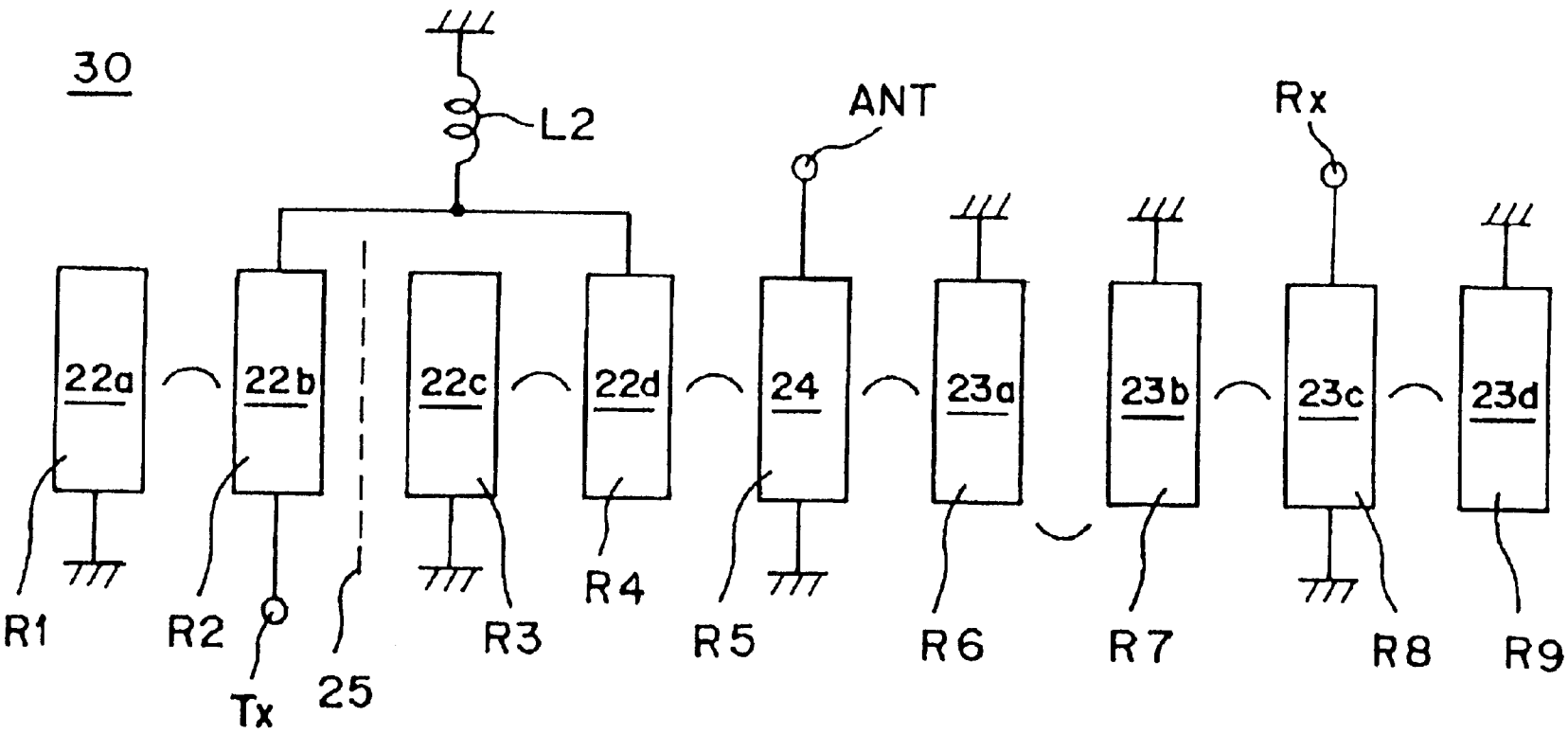
FIG. 5 is an electric equivalent circuit diagram showing a second preferred embodiment of the dielectric duplexer according to the present invention.

[Second Preferred Embodiment, FIG. 5]

The electric equivalent circuit of a second preferred embodiment of the dielectric duplexer according to the present invention is shown in FIG. 5. In a dielectric duplexer 30, the dielectric resonator R4 and the dielectric resonator R2 which is connected to the transmitting terminal Tx are grounded through a microinductance L2. In other words, the structure is equivalent to that in which the nonconductive portion 43 is disposed on a first end surface 26 of the dielectric duplexer 20 employed in the first embodiment by cutting away the outer conductor 36 in a letter-C form so as to surround the resonator holes 22*b*, 22*c*, 22*d*, and the ground hole 25 which is disposed between the resonator holes 22*b* and 22*c*, on the inner part 41. The microinductance L2 is formed by the conductor pattern 44, which is located near the center of the nonconductive portion 43. The dielectric resonator R3 and the dielectric resonator R2 which is connected to the transmitting terminal Tx are electrically shielded to each other by the inner conductor 35 formed in the ground hole 25 formed therebetween.

In the dielectric duplexer 30, similar to the first embodiment, the dielectric resonators R2 and R4 are grounded through the microinductance L2 to produce a comb-line coupling, so that the mounting height h can be significantly lower than that of the conventional art, and the characteristics can be enhanced.

Figure 6:
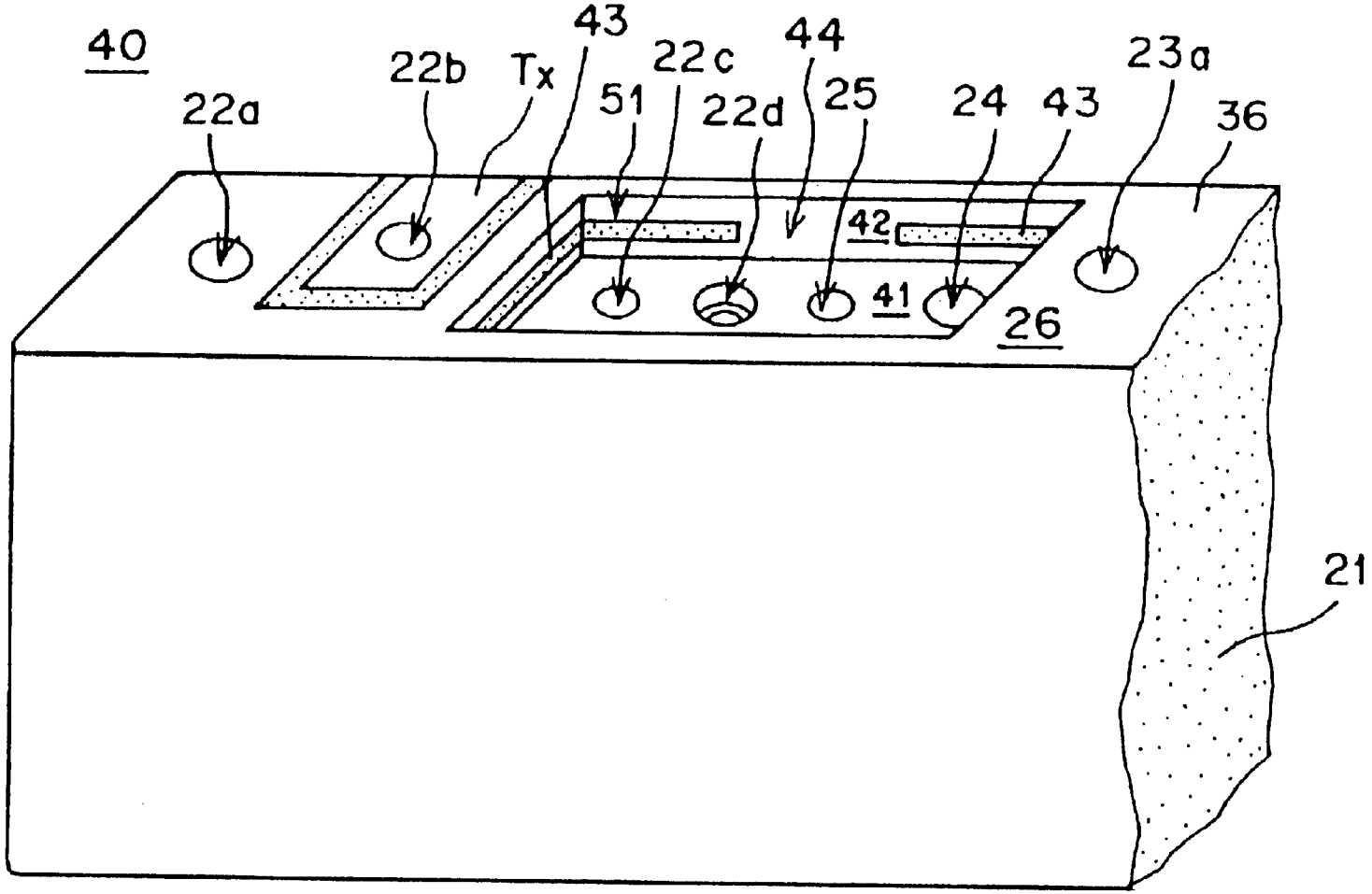
FIG. 6 is a partially cut-away perspective view showing a structure of a third preferred embodiment of the dielectric duplexer according to the present invention.

[Third Preferred Embodiment, FIG. 6]

A third preferred embodiment of the dielectric duplexer according to the present invention is shown in FIG. 6. A dielectric duplexer 40 has such an arrangement that, in the dielectric duplexer 20 of the first embodiment, respective openings of the resonator holes 22*c*, 22*d*, and 24, and the ground hole 25 are formed in a recess 51 on a first end surface 26 of the dielectric block 21; and the outer conductor 36 is cut away on the inner peripheral wall of the recess 51 so as to dispose the nonconductive portion 43.

When such an arrangement is provided, since the openings of the resonator holes 22*c*, 22*d*, and 24, and the ground hole 25 are recessed from the first end surface 26 of the dielectric block 21, in addition to the effects created by the dielectric duplexer 20 of the first embodiment, high frequencies generated in the dielectric duplexer 40 are unlikely to leak outside. Moreover, influence due to high frequencies from the outside on the dielectric duplexer 40 can be reduced.

Figure 7:
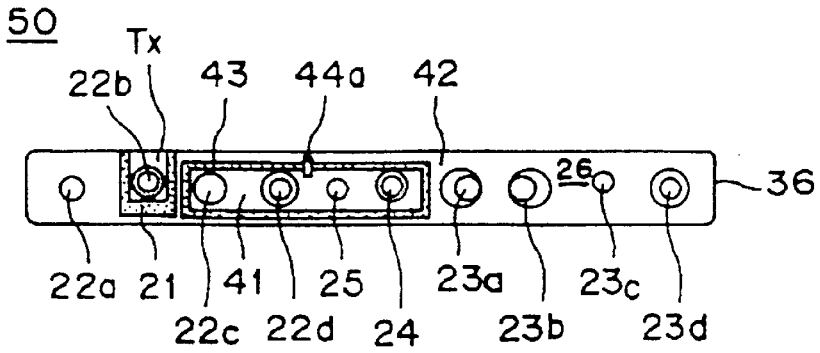
FIG. 7 is a front view showing a fourth preferred embodiment of the dielectric duplexer according to the present invention.

[Fourth Embodiment, FIG. 7]

A front view of a fourth preferred embodiment of the dielectric duplexer according to the present invention is shown in FIG. 7. A dielectric duplexer 50 has such an arrangement that the nonconductive portion 43 of the dielectric duplexer 20 shown in FIG. 1 is formed in a ring-shape, in which the inner part 41 and the outer part 42 are mutually connected through a metallic lead wire 44*a* so as to use the metallic lead wire 44*a* as a microinductance. Such an arrangement permits easy adjustment of inductance-values of the microinductance by modifying the length and shape of the metallic lead wire 44*a*.

Figure 8:
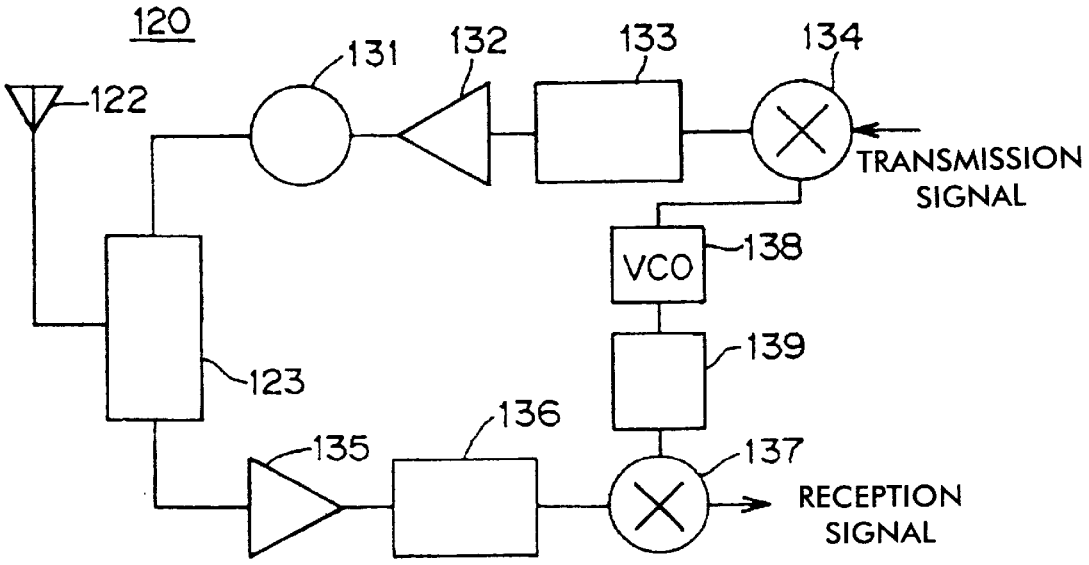
FIG. 8 is a block diagram showing one preferred embodiment of a transceiver according to the present invention.

[Fifth Preferred Embodiment: FIG. 8]

A fifth preferred embodiment shows an embodiment of a transceiver according to the present invention, in which an example of a mobile phone is illustrated.

FIG. 8 is an electric circuit block diagram of RF section of a mobile phone 120. In FIG. 8, reference numeral 122 denotes an antenna device; reference numeral 123 denotes an antenna-shared filter (duplexer); reference numeral 131 denotes a transmitting-side isolator; reference numeral 132 denotes a transmitting-side amplifier; reference numeral 133 denotes a transmitting-side inter-stage band-pass filter; reference numeral 134 denotes a transmitting-side mixer; reference numeral 135 denotes a receiving-side amplifier; reference numeral 136 denotes a receiving-side inter-stage band-pass filter; reference numeral 137 denotes a receiving-side mixer; reference numeral 138 denotes a voltage-controlled oscillator (VCO); and reference numeral 139 denotes a local band-pass filter. In this case, it is possible to use, for example, the duplexer 20, 30, 40, or 50 of the first through fourth embodiments as an antenna-shared filter (duplexer) 123. Mounting of the dielectric duplexer 20, 30, 40, or 50 can reduce the height of the RF section so as to obtain a slim mobile phone. [Other Embodiments]

A dielectric filter, a dielectric duplexer, and a transceiver according to the present invention should not be construed to the above-described embodiments, and various changes and modifications are possible without departing from the spirit and scope of the present invention. More particularly, although a description has been given of a dielectric dupulexer and a transceiver in the embodiments above, it is to be understood that a dielectric filter such as a band-block filter or the like can be applied.

As clearly seen from the given description above, according to the present invention, since among respective dielectric resonators formed by at least three resonator holes surrounded by a nonconductive portion, a dielectric resonator, whose part of a first end surface side being a short-circuit end, is grounded through a microinductance to produce a comb-line coupling, it is not necessary to dispose the mutually coupling dielectric resonators in a staggering form in a dielectric block, so that the mounting height is significantly lower than that of the conventional art, and the characteristics are also improved. Moreover, since the present invention adopts a simple alignment of the resonator holes formed in the dielectric block, manufacturing of the dielectric block is easy.

In addition, when at least three resonator holes surrounded by the nonconductive portion are disposed in a recess formed on the short-circuit surface of the dielectric block to form a nonconductive portion on the inner wall surface of the recess, the short-circuit surfaces of the dielectric resonators are recessed from a first end surface of the dielecric block so as to strengthen shielding of the openings of the dielectric resonators in the recess. This not only makes high frequencies generated in the dielectric resonators unlikely to leak out, but also permits influence due to high frequencies from the outside on the dielectric resonators to be reduced. Furthermore, mounting a dielectric filter and a dielectric duplexer according to the present invention allows the height of a transceiver to be reduced.

While the invention has been particularly shown and described with reference to preferred embodiments thereof, it will be understood by those skilled in the art that the forgoing and other changes in form and details may be made therein without departing from the spirit of the invention.

What is claimed is:

1. A dielectric filter including a plurality of dielectric resonators, the dielectric filter comprising:

a dielectric block having a first surface and a second end surface opposite to each other;

at least three resonator holes passing through the first end surface to the second end surface of the dielectric block;

inner conductors disposed on the inner wall surfaces of the resonator holes;

an outer conductor disposed on the external surface of the dielectric block;

the outer conductor on the first end surface of the dielectric block being separated into an inner part and a peripheral part by a nonconductive portion;

the inner part including the openings of at least three of the resonator holes adjacent to each other;

a peripheral part being arranged around the inner part; and the inner part and the peripheral part being connected by a microinductance.

2. The dielectric filter according to claim 1, wherein the openings of the resonator holes included in the inner part are disposed in a recess provided on the first end surface of the dielectric block, and the nonconductive portion is disposed on the inner wall surface of the recess.

3. The dielectric filter according to claim 1 or claim 2, wherein the microinductance is a conductor pattern integrated with the outer conductor.

4. The dielectric filter according to claim 1 or claim 2, wherein the microinductance is a metallic lead wire.

5. The dielectric filter according to claim 1 or claim 2, wherein a coupling-block ground hole is disposed between the resonator holes the openings of which are included in the inner part.

6. A dielectric duplexer including a plurality of dielectric resonators constituting a transmitting side and a receiving side, comprising:

a dielectric block having a first end surface and a second end surface opposite to each other;

at least three resonator holes passing through the first end surface to the second end surface of the dielectric block and constituting a transmitting side and a receiving side;

inner conductors disposed on the inner wall surfaces of the resonator holes;

an outer conductor disposed on the external surface of the dielectric block;

the outer conductor on the first end surface of the dielectric block being separated into an inner part and a peripheral part by a nonconductive portion;

the inner part including the openings of at least three of the resonator holes adjacent to each other;

a peripheral part being arranged around the inner part; and the inner part and the peripheral part being connected by a microinductance.

7. The dielectric duplexer according to claim 6, wherein the openings of the resonator holes included in the inner part are disposed in a recess provided on the first end surface of the dielectric block, and the nonconductive portion is disposed on the inner wall surface of the recess.

8. The dielectric filter according to claim 6 or claim 7, wherein the microinductance is a conductor pattern integrated with the outer conductor.

9. The dielectric filter according to claim 6 or claim 7, wherein the microinductance is a metallic lead wire.

10. The dielectric filter according to claim 6 or claim 7, wherein a coupling-block ground hole is disposed between the resonator holes the openings of which are included in the inner part.

11. The dielectric filter according to claim 3, wherein a coupling-block ground hole is disposed between the resonator holes the openings of which are included in the inner part.

12. The dielectric filter according to claim 4, wherein a coupling-block ground hole is disposed between the resonator holes the openings of which are included in the inner part.

13. The dielectric filter according to claim 8, wherein a coupling-block ground hole is disposed between the resonator holes the openings of which are included in the inner part.

14. The dielectric filter according to claim 9, wherein a coupling-block ground hole is disposed between the resonator holes the openings of which are included in the inner part.

15. A radio communication device, wherein said device comprises at least one radio circuit selected from the group consisting of a transmitting circuit and a receiving circuit, said radio circuit comprising a dielectric filter including a plurality of dielectric resonators, the dielectric filter comprising:

a dielectric block having a first end surface and a second end surface opposite to each other;

at least three resonator holes passing through the first end surface to the second end surface of the dielectric block;

inner conductors disposed on the inner wall surfaces of the resonator holes;

an outer conductor disposed on the external surface of the dielectric block;

the outer conductor on the first end surface of the dielectric block being separated into an inner part and a peripheral part by a nonconductive portion;

the inner part including the openings of at least three of the resonator holes adjacent to each other;

a peripheral part being arranged around the inner part; and the inner part and the peripheral part being connected by a microinductance.

16. A radio communication device comprising:

a dielectric duplexer including a plurality of dielectric resonators constituting a transmitting side and a receiving side, comprising:

a dielectric block having a first surface and a second end surface opposite to each other;

at least three resonator holes passing through the first end surface to the second end surface of the dielectric block and constituting a transmitting side and a receiving side;

inner conductors disposed on the inner wall surfaces of the resonator holes;

an outer conductor disposed on the external surface of the dielectric block;

the outer conductor on the first end surface of the dielectric block being separated into an inner part and a peripheral part by a nonconductive portion;

the inner part including the openings of at least three of the resonator holes adjacent to each other;

a peripheral part being arranged around the inner part; and the inner part and the peripheral part being connected by a microinductance;

a transmitting circuit connected to said transmitting side of said duplexer; and a receiving circuit connected to said receiving side of said duplexer.

* * * * *